US006149213A

United States Patent [19]

Sokurenko et al.

[11] Patent Number: 6,149,213

[45] Date of Patent: Nov. 21, 2000

[54] BLIND LATCH KEEPER

[75] Inventors: William E. Sokurenko, Glenolden, Pa.; D. Dale Turner, Honeoye Falls, N.Y.; James T. DeCecchis, deceased, late of Wilmington, Del., by Sara G. DeCecchis, administratrix

[73] Assignee: Southco, Inc., Concordville, Pa.

[21] Appl. No.: 09/165,265

[22] Filed: Oct. 1, 1998

[51] Int. Cl.[7] ..... E05B 15/02

[52] U.S. Cl. ..... 292/340; 292/DIG. 55; 292/DIG. 38; 292/174

[58] Field of Search ..... 292/174, DIG. 72, 292/DIG. 51, 341.14, 341.19, 175, 246, 302, 333, 176, DIG. 38, 340, DIG. 53, 341.18, DIG. 55, DIG. 60; 411/107

[56] References Cited

U.S. PATENT DOCUMENTS

| | | | |
|---|---|---|---|
| 2,718,073 | 2/1955 | Trafton | 411/107 |
| 3,093,222 | 6/1963 | Christoffersen et al. | 411/107 |
| 4,488,844 | 12/1984 | Baubles | 411/85 |
| 4,597,599 | 7/1986 | Bisbing . | |
| 4,790,701 | 12/1988 | Baubles | 411/85 |
| 4,832,386 | 5/1989 | Sweet | 292/264 |
| 4,917,413 | 4/1990 | Jason et al. | 292/76 |
| 5,096,239 | 3/1992 | Rippberger et al. | 292/128 |
| 5,139,293 | 8/1992 | Zimmerman et al. | 292/DIG. 60 |
| 5,183,302 | 2/1993 | Pelachyk et al. | 292/336.3 |
| 5,226,302 | 7/1993 | Anderson | 70/159 |

OTHER PUBLICATIONS

Southco Latches and Access Hardware Handbook 43, pp. G–14, G–15, G–16 and G–17 (1993).

*Primary Examiner*—Lynne H. Browne
*Assistant Examiner*—John B. Walsh
*Attorney, Agent, or Firm*—Paul & Paul

[57] ABSTRACT

A blind latching system secures a closure element to a storage structure. A keeper sub-assembly is mounted in a fixed position for engagement by a latch sub-assembly which is affixed to and moves with the closure element. The keeper sub-assembly includes a keeper pin defining a generally elongated shaft, a mounting bracket into which the keeper pin is received and a housing for permitting alignment of the keeper pin when fastening with the latch sub-assembly.

17 Claims, 7 Drawing Sheets

BLIND LATCH KEEPER

BACKGROUND OF THE INVENTION

1. Field of the Invention

The present invention relates generally to blind latching systems for doors, panels and the like such as cabinets or other similar storage structures in which the cabinet or the like is closed by means of a door or panel which will remain in a closed position until released, and more particularly to keepers adaptable for use in blind latching systems.

2. Brief Description of the Prior Art

Blind latching systems are known and generally comprise a latch sub-assembly and a keeper sub-assembly. In operation, the latch sub-assembly and keeper subassembly are attached to opposing panels, such as a door of a cabinet structure and the corresponding frame. The latch sub-assembly and keeper sub-assembly when mounted are completely invisible from outside the cabinet when the door is in the closed position. The opening and closing of the door is accomplished by a simple push operation against the door.

A blind latching system is illustrated in U.S. Pat. No. 4,597,599 ("'599 Patent") to Robert H. Bisbing and assigned to Southco, Inc., the assignee of the present invention, the entire disclosure of which is hereby incorporated by reference. The '599 Patent discloses a latch sub-assembly and keeper sub-assembly mounted in a fixed position to the door and frame of a cabinet enclosure. The keeper sub-assembly includes a mounting bracket and a threaded keeper pin. The keeper pin is positioned in an opening extending through the mounting bracket and is locked in position by means of threaded nuts and lock washers. The mounting bracket also is provided with a pair of through holes for receiving tightening screws for attachment of the keeper sub-assembly to the cabinet frame. Latching and unlatching is accomplished through alignment of the male keeper pin with a female component of the latch subassembly.

Another prior art blind latching system is similar to that disclosed in the '599 Patent but includes a "floating" keeper in order to assist in alignment of the male keeper pin with the female component of the latch sub-assembly. The floating keeper sub-assembly is illustrated in the Southco Latches and Access Hardware North America Edition—47 N.A. on pages G-12 through G-14 and is comprised of eight components including a threaded keeper pin, a mounting bracket having an opening for receiving the keeper pin, the size of the opening being larger than the diameter of the keeper pin, an eyelet, a U-bent washer, two lock washers and two retaining nuts. The U-bent washer and eyelet are each received onto the keeper pin and are positioned against opposing surfaces of the mounting bracket by the lock washers and retaining nuts. The floating of the keeper sub-assembly is accomplished by movement of the keeper pin within the large size opening of the mounting bracket, which in operation assists in alignment of the keeper pin with the female component of the latch sub-assembly. In addition, lateral movement of the keeper pin is accomplished by adjustment of the two retaining nuts along the length of the threaded portion of the keeper pin.

In view of that set forth above, there is seen a need for an improved floating keeper sub-assembly comprised of minimal parts and which affords simple assembly and operation.

SUMMARY OF THE INVENTION

The present invention discloses an improved keeper sub-assembly for a blind latching system. For this purpose, the present invention discloses a self-aligning keeper comprising a generally elongated shaft, a bracket including at least one wall defining outer and inner surfaces with an opening therethrough, and means for aligning the keeper comprising a substantially non-metallic housing having an aperture therethrough for receiving the generally elongated shaft and which engages at least the outer surface of the at least one wall of the bracket.

In accordance with the present invention, an object is to provide a floating keeper comprised of minimal parts and which can be used in a blind latching system.

Another object of the present invention is to provide a floating keeper which provides for both a quick and simplified assembly and adjustment during operation.

It is still another object of the present invention to provide a floating keeper sub-assembly which is made from inexpensive materials.

Another object of the present invention is to provide a floating keeper sub-assembly which affords protection for its various components, such as from dust, dirt or other matter or from impact sources from interfering with operation.

Still another object of the present invention is to provide a floating keeper sub-assembly in which many of the components are either consolidated or hidden from view.

These and other object of the present invention will become more readily apparent when taken into consideration with the following description and attached drawings.

DETAILED DESCRIPTION OF THE PREFERRED EMBODIMENTS

Figure 1:
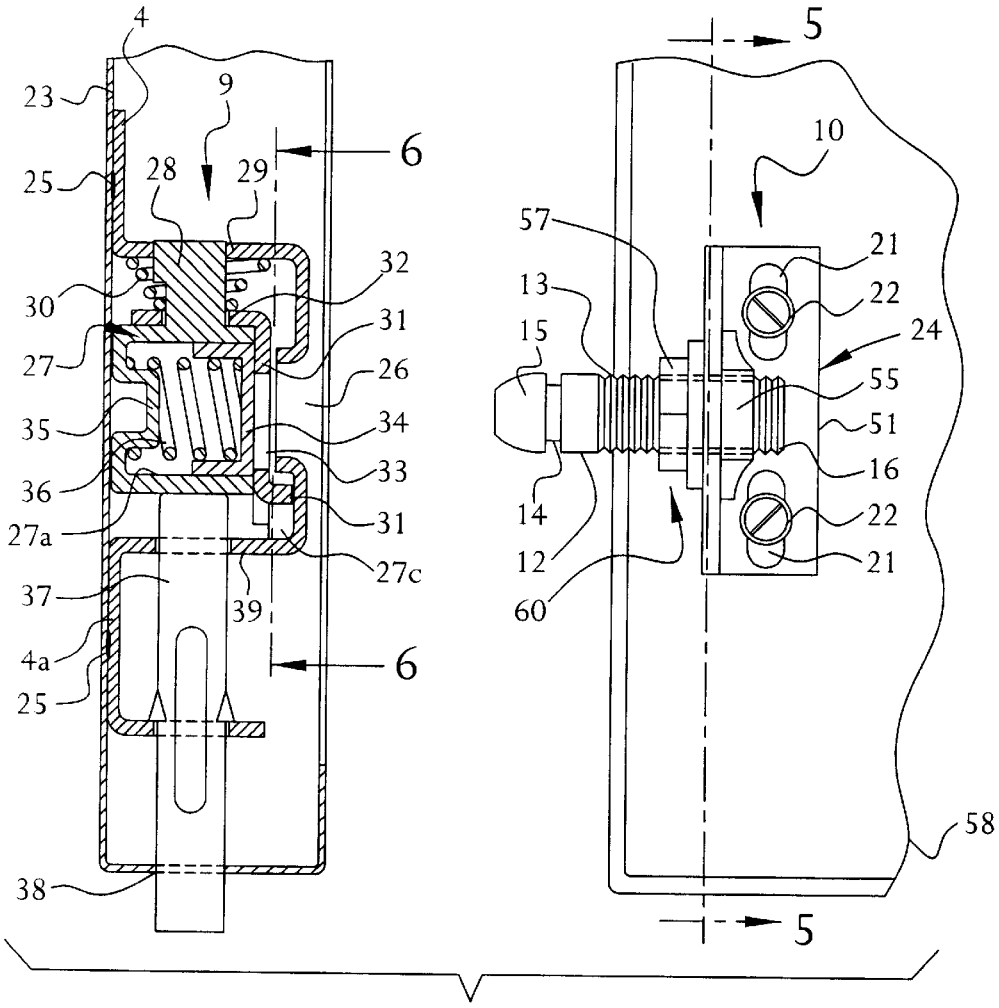
FIG. 1 is a partially sectional front elevational view illustrating an embodiment of a blind latching system comprising a latch sub-assembly attached to a first panel and a keeper sub-assembly attached to a second panel.

The present invention is directed to a floating keeper sub-assembly, which has broad application and may be used in a wide variety of latches. Illustrated in FIG. 1 is one form of latch to which the floating keeper sub-assembly in accordance with the present invention may be applied. The particular latch shown in FIG. 1 is a blind latching system comprising, as portions thereof a latch subassembly and an embodiment of a floating keeper sub-assembly. The latch sub-assembly illustrated in FIG. 1 corresponds to a latch sub-assembly 9 shown, described and claimed in U.S. Pat. No. 4,597,599 which, as indicated above, is hereby incorporated by reference. As illustrated in FIG. 1, the latch sub-assembly 9 and floating keeper sub-assembly 10 are attached to respective panel members 23 and 58 shown in section, which in this embodiment comprises a cabinet and corresponding door, the details of which will be more fully described herein.

As illustrated in FIG. 1, the latch sub-assembly 9 comprises a mounting bracket 4 attached to the inner surface of panel member 23 such as by welds 25 or the like. The mounting bracket 4 in this embodiment is provided having four openings 26, 29, 39 and 39A which receive other structural or operative elements as hereinafter described. Positioned within mounting bracket 4 is a moveable latch guide 27 having a stud 28 which extends into mounting bracket opening 29. Spring 30 is mounted on stud 28 and engages latch plate 31 at its upper surface. Latch plate 31 is provided with an opening 32 through which stud 28 extends, and likewise is provided with an opening 33. As will be described below, the floating keeper sub-assembly includes a keeper pin which extends into the opening 33 when the panel member 23 is moved into a closed position. In addition, movably positioned within a cavity formed in latch guide 27 is a cup 34, which in operation is engaged by the keeper pin of the floating keeper sub-assembly as the panel member 23 is moved toward the closed position, as will be described below. A spring 36 is mounted on pedestal 35 and engages the inner surface of cup 34 to provide a biasing action urging cup 34 outwardly against the keeper pin, so that in operation latch plate 31 will be held snugly within a groove of the keeper pin after the latch plate 31 drops into the keeper pin groove when the panel member 23 moves to its closed position shown in FIG. 2. This biasing force also serves to open the panel member 23 when the closed door is unlatched. The release rod 37 is provided for disengaging latch plate 31 from the keeper pin groove when it is desired to open the panel member 23. In the present embodiment, the release rod 37 is preferably constructed of a yieldable plastic material and is provided with a slot 41, which gives sufficient flexibility to the rod 37 to move the stops 40 inwardly in order to insert or withdraw rod 37 through openings 38 and 39A on assembly or disassembly of the latch subassembly 9.

Figure 2:
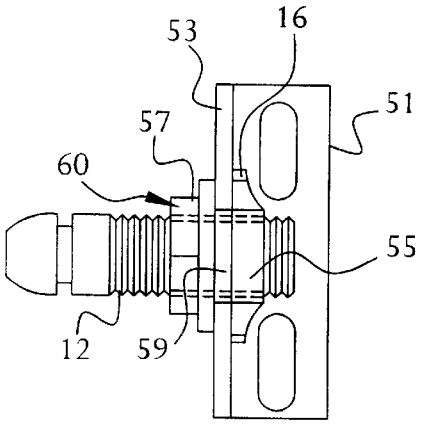
FIG. 2 is an isolated rear elevational view of the keeper sub-assembly of FIG. 1.
Figure 3:
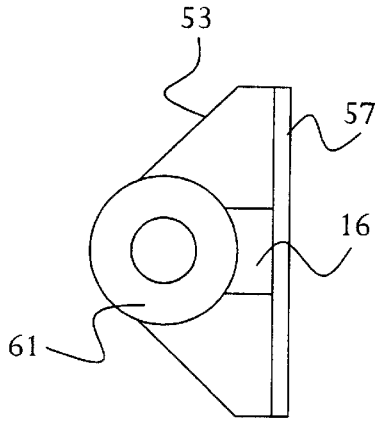
FIG. 3 is an isolated right side elevational view of the keeper sub-assembly of FIG. 1.
Figure 4:
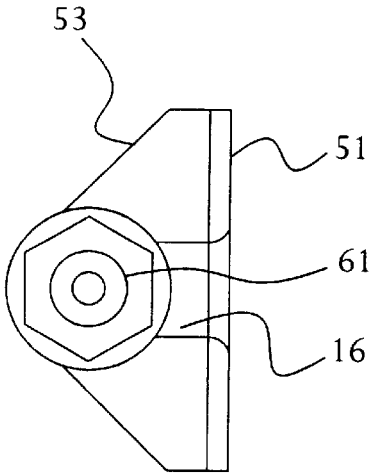
FIG. 4 is an isolated left side elevational view of the keeper sub-assembly of FIG. 1.
Figure 5:
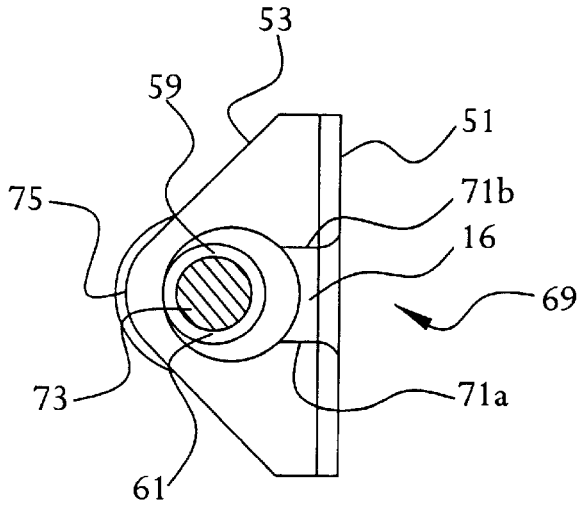
FIG. 5 is an isolated left side elevational view of the keeper sub-assembly of FIG. 1 taken along the line 5—5.
Figure 6:
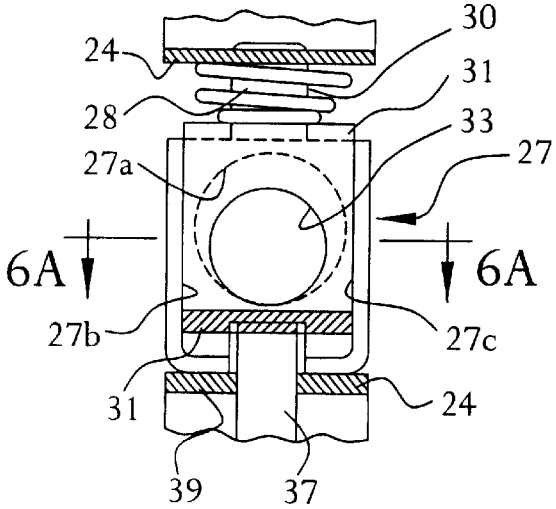
FIG. 6 is a sectional view of the latch sub-assembly of FIG. 1 taken along the line 6—6.
Figure 6A:
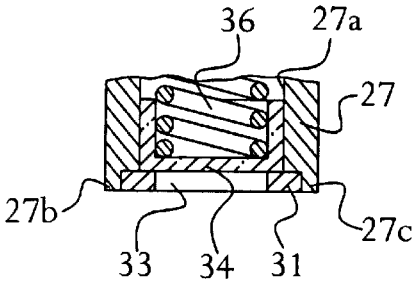
FIG. 6A is a sectional view taken along the line 6A—6A of FIG. 6.

The floating keeper sub-assembly 10 of the present embodiment as illustrated in FIGS. 1–5 comprises a mounting bracket 24, a keeper pin 12 and means for aligning the keeper shown at 60. As illustrated in FIG. 1, the mounting bracket 24 is provided with a pair of slots 21 for attachment to the panel member 58 by a pair of screws 22 or the like. The mounting bracket 24 in this embodiment comprises a generally rectangular first portion 51 through which the slots 21 are formed and a generally triangular shaped second portion 53 attached to and extending at substantially 90 degrees from one end of the first portion 51. In addition, the mounting bracket 24 further includes an opening 16 therethrough into which the keeper pin 12 is received. In this embodiment, the opening 16 at least extends through the second portion 53 and preferably extends through each of the first and second portions 51 and 53 of the mounting bracket 24. As best illustrated in FIG. 5, the portion of the opening 16 extending through the second portion 53 is generally mushroom shaped defined by a generally rectangular shaped section adjacent to the first portion 51 and a generally radiused end section attached with the generally rectangular shaped section of the opening 16. As best illustrated in FIGS. 1 and 2, the portion of the opening 16 extending through the first portion 51 of the mounting bracket 24 is preferably sized to allow passage of a portion of the aligning means 60, and more preferably in this embodiment, the configuration of the portion of the opening 16 extending through the first portion 51 corresponds in configuration with a portion of the aligning means 60, as will be described in more detail below.

The keeper pin 12 in the present embodiment is a generally elongated shaft provided having threads 13 formed in the shank thereof; and a nose element 15 at the forward end defining curved side walls providing cam surfaces extending rearwardly and terminating in a groove 14 located immediately to the rear of nose element 15. In this embodiment, the position of the keeper pin 12 within the opening 16 through the mounting bracket 24 is retained by the aligning means 60, as is described in more detail below.

The guide means 60 in this embodiment preferably comprises a housing of one-piece in construction and comprised of a substantially non-metallic material, such as a polymeric material made by injection molding or the like, although it should be understood that other suitable materials and manufacturing processes can also be used for the same purpose. In the present embodiment, the housing 60 is best seen in FIGS. 1 and 2 and is comprised of a first outer portion 55, a second outer portion 57 and an inner portion 59 between and connecting the first and second outer portions 55 and 57. The configuration of the first outer portion 55 in this embodiment is generally button shaped and the configuration of the second outer portion 57 in this embodiment comprises a substantially disk shaped top and a slightly smaller diameter bottom having six sides, although as should be understood, other configurations may also be utilized for the same purpose. As illustrated in FIG. 2, the housing 60 is positioned within the portion of the opening 16 extending through the second portion 53 of the bracket 24. The second portion 53 in this embodiment defines at least one wall substantially elongated along a longitudinal axis defining an outer surface and an inner surface, and with the inner portion 59 of the housing 60 extending through the opening 16 of the second portion 53, the first outer portion 55 of the housing 60 engaging the outer surface of the wall 53 and the second outer portion 57 engaging the inner surface of the wall 53. In this embodiment, each of the first and second outer portions 55 and 57 and inner portion 59 of the housing 60 define a diameter substantially parallel to the longitudinal axis of the wall 53 and with the diameter of the inner portion 59 being generally smaller than the diameter of both the first and second outer portions 55 and 57 of the housing 60. In the present embodiment, a gap is present between the first outer portion 55 and second outer portion 57 due to the smaller diameter of the inner portion 59 and the size of the gap is large enough to receive a portion of the wall 53 into the gap. As best shown in FIGS. 3–5, preferably the housing 60 includes a channel 61 therethrough for receiving the keeper pin 12. In this embodiment, at least one and preferably each of the first and second outer portions 55 and 57 and inner portion 59 include a threaded channel therethrough for receiving the threaded shank 13 of the keeper pin 12. As will be described in more detail below, the keeper pin 12 is adjustable in a lateral direction substantially perpendicular to the inner and outer surfaces of the wall 53, as well as adjustable in a direction substantially parallel to the longitudinal axis of the wall 53 by the housing 60.

The assembly of the housing 60 within the opening 16 through the mounting bracket 24 will now be described. The housing 60 in this embodiment is assembled into the opening 16 in the direction of arrow 69 shown in FIG. 5, so that the first outer portion 55 of housing 60 is passed through the portion of the opening 16 within the first section 51, and with the inner portion 59 of housing 60 being inserted into the portion of opening 16 at the perimeter of the wall 53. As indicated earlier, preferably the configuration of the portion of opening 16 within the first section 51 is sized slightly larger than and of the same configuration as the first outer portion 55, which is generally button shaped in this embodiment. In addition, in this embodiment preferably the spacing between surfaces 71*a* and 71*b* defined by the generally rectangular portion of the opening 16 through the wall 53 is slightly larger than the diameter of the inner portion 59 of housing 60, in order that the housing 60 preferably can be moved into the position illustrated in FIG. 5. As shown in FIG. 5, the inner portion 59 is engaging an inner surface 73 of the wall 53 defined by the substantially radiused portion of the opening 16 and is also substantially opposing an outer surface 75 of the wall 53 that is furthest from the first section 51 of the mounting bracket 24.

Assembly of the housing 60 and mounting bracket 24 is preferably carried out when the keeper pin 12 is not connected with the housing 60, although this is not required; for example, in this embodiment, the keeper pin 12 can be positioned within the channel section 61 through the housing 60 as long as the keeper pin 12 does not extend out past the first outer portion 55, which would interfere with assembly by contacting the first section 51 of the mounting bracket 24. Attachment of the mounting bracket 24 to the panel member 58 as described above preferably follows the assembly of the housing 60 and mounting bracket 24.

The operation of the keeper sub-assembly 10 in relation to the latch sub-assembly 9 will now be described. The keeper pin 12 in this embodiment can be adjusted laterally in a direction substantially perpendicular to the longitudinal axis of the wall 53 by either clockwise or counterclockwise rotation in order to adjust the position of the threaded portion 13 of the keeper pin 12 relative to the threaded channel 61 of the housing 60. In addition, as will be described hereinafter, adjustment of the keeper pin 12 in a direction substantially parallel to the longitudinal axis of the wall 53 occurs through movement of the housing 60 within the portion of the opening 16 through the wall 53; in particular, in this embodiment, the keeper pin 12 is capable of movement in any direction along the longitudinal axis of the wall 53 via movement of the housing 60 within the substantially radiused portion of the opening 16 of the wall 53. Excessive movement of the housing 60 in a direction of the first section 51 is restricted due to the smaller spacing between the surfaces 71*a* and 71*b* defined by the generally rectangular shaped portion of the opening 16 through the wall 53; in particular, a greater force is required in order to pass the inner portion 59 of the housing 60 into and through the generally rectangular shaped portion of the opening 16. In addition, in this embodiment, the portion of the wall 53 extending within the gap between the first and second outer portions 55 and 57 provide slight frictional resistance so that the housing 60 when moved relative to the mounted bracket 24 will have a tendency to maintain its given position. In addition, as discussed above, the spacing between the surfaces 71*a* and 71*b* work to keep the housing 60 within the substantially radiused portion of the opening 16, due to the increased force on the housing 60 that would be required to pass the inner portion 59 through the space between surfaces 71*a* and 71*b*.

Figure 7:
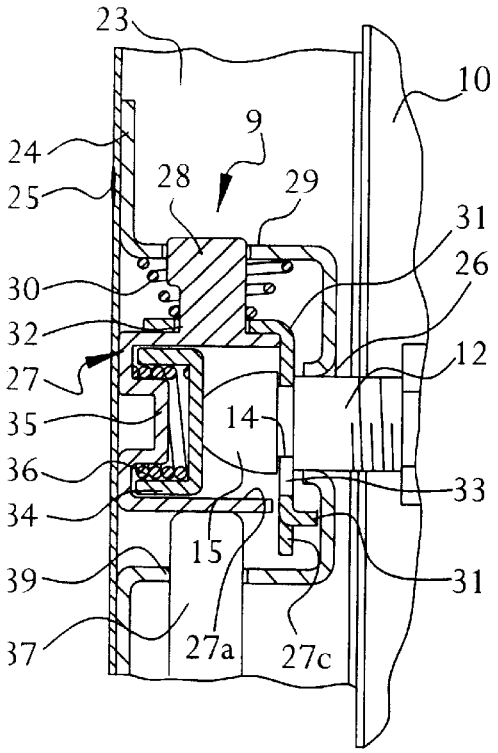
FIG. 7 is a cross-section similar to FIG. 1 showing a latched position.

The function of the floating keeper sub-assembly 10 when latched and unlatched relative to the latch sub-assembly 9 will now be described. FIG. 7 of the drawings is a cross-section view of the latch sub-assembly 9 and a part of the keeper sub-assembly 10 with the enclosure 23 in its fully closed position. In this figure, the latch plate 31 has moved downwardly into the groove 14 in response to the bias force of spring 30. Likewise, cup 34 has moved laterally against the bias of spring 36 in response to a force generated by movement of cup 34 against immovable keeper pin 12, which force has compressed spring 36 as shown. This action occurs on movement of closure 23 toward its closed position.

Figure 8:
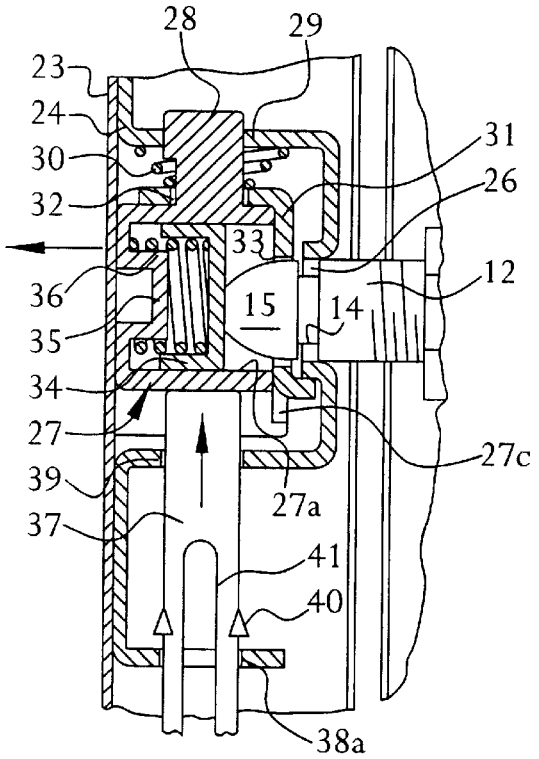
FIG. 8 is a cross-section similar to FIG. 1 showing a partially opened position.
Figure 9:
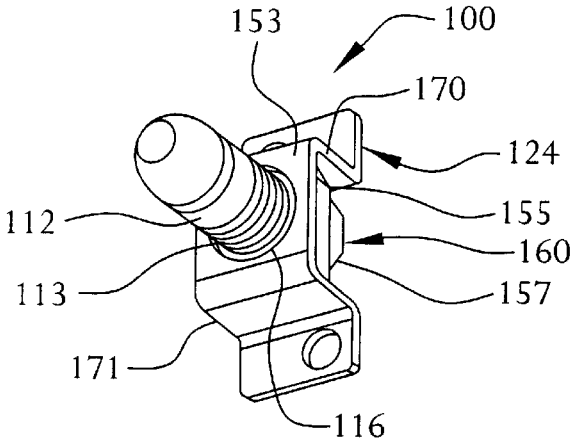
FIG. 9 is an isolated perspective view of another embodiment of the keeper sub-assembly of FIG. 1.

FIG. 8 is a cross-section of the latch sub-assembly 9 and a part of the keeper sub-assembly 10 showing the enclosure 23 in a partly opened position and showing release rod 37 and the associated latch guide means 27 in a released position. In this embodiment of the invention, release rod 37 is operated by depressing the end of release rod 37 where it projects through opening 38 in the closure 23 as shown in FIG. 1.

As discussed above, a feature of the present invention is that the floating keeper sub-assembly 10 will compensate for misalignment relative to the latch sub-assembly 9 and/or misalignment of the two panel members 23 and 58. For example, on assembly of the keeper sub-assembly 10, preferably the mounting bracket 24 is properly positioned on a surface of the second panel member 58 and locked in position by tightening screws 22 and the lateral position of the keeper pin 12 is properly adjusted through its clockwise or counterclockwise rotation. In this embodiment the latch sub-assembly 9 is mounted on the inner surface of the first panel 23 comprising the front panel of a door and moves toward or away from the keeper pin 12 as the door 23 is closed or opened. Where there is misalignment, the cam surfaces on the nose 15 of the keeper pin 12 is engaged by the mounting bracket 4 adjacent to the opening 26, providing subsequent displacement of the keeper pin 12 relative to the mounting bracket 24 due to corresponding displacement of the housing 60. Thereafter, continued movement of the door 23 toward the keeper pin 12 results in engagement by latch plate 31 under nose 15, raising the latch plate 31 and compressing spring 30 to provide a biased force urging latch plate 31 toward the keeper pin 12. Further closing of the door 23 results in a further raising of latch plate 31 until the latch plate reaches the inner end of the cam surface on the nose 15 of keeper pin 12. At this point, further closing movement of the door 23 results in the latch plate 31 dropping into groove 14 in response to the bias generated in spring 30. The door 23 is now in a locked position since no opening or closing movement of the door 23 is possible until latch plate 31 is disengaged from the groove 14. Such disengagement is accomplished by moving release rod 37 upwardly, which results in moving latch guide 27 and its associated biasing means 36 upwardly as shown in FIG. 8. Since latch guide 27 is in operative contact with the under surface of the latch plate 31, there is a lifting action of latch plate 31, which results in disengaging latch plate 31 from groove 14 and thus unlocking door 23, which is sprung open by the bias force generated in spring 36. At the same time, latch plate 31 moves down in contact with the cam surface on the nose 15 of the keeper pin 12 in response to the combined biasing actions of spring 30 and 36 on release of the upward force of rod 37, which force is no longer needed after latch plate 31 has been disengaged from the groove 14 and the door 23 has started to open.

Modifications of the latch sub-assembly 9 are also possible, such as to provide the release rod 37 completely enclosed within the door 23 and which is operated by a tool that is inserted through an opening in the door 23.

In the present embodiment, the keeper pin 12 and mounting bracket 24 are each preferably comprised of a sufficiently durable material, such as formed from steel, although other suitable materials and manufacturing processes can also be used where desired. In addition, in this embodiment, while the housing 16 is preferably of one-piece in construction and comprised of acetal, the housing 60 may also be comprised of other suitable materials and by additional manufacturing processes and the components of the housing 60 can be comprised as two or more separate components. Also, the components of the housing 60 comprising the first and second outer portions 55 and 57 and inner portion 59 may also be provided of other configurations as well. Similarly, the keeper pin 12 as well as the mounting bracket 24 can be provided in other configurations.

In FIGS. 9–14 is shown another embodiment of a keeper sub-assembly in accordance with the present invention. The keeper sub-assembly 100 in this embodiment comprises a mounting bracket 124, a keeper pin 112 and an aligning means 160 comprising a housing 155 and a retaining member 157. The keeper pin 112 in this embodiment is the same as the keeper pin 112 illustrated in FIGS. 1–8, and for this reason will not be more fully described herein.

Figure 10:
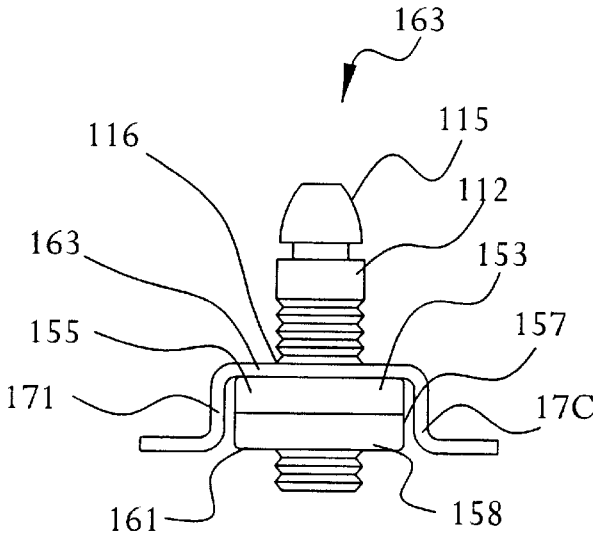
FIG. 10 is an isolated right side elevational view of the keeper sub-assembly of FIG. 9.
Figure 11:
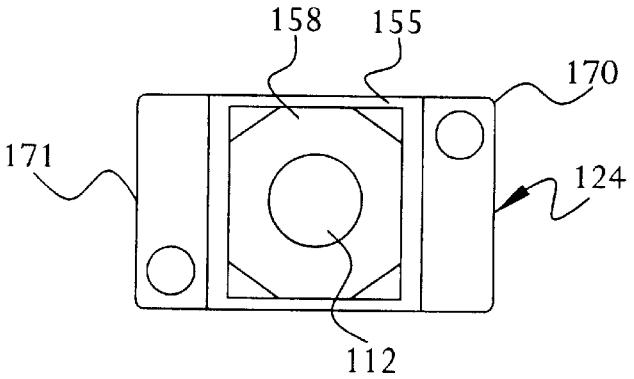
FIG. 11 is an isolated rear elevational view of the keeper sub-assembly of FIG. 9.

The housing 155 in this embodiment is generally square in configuration having a generally circular shaped aperture 156 shown in dotted lines in FIG. 10 and preferably is comprised substantially of an elastomeric material, such as rubber, although other suitable configurations and materials can also be used for this same purpose.

The retaining member 157 in this embodiment comprises a retaining nut having a threaded opening 158 therethrough shown in dotted lines in FIG. 10. In this embodiment, the retaining member 157 is octagonal in configuration and is comprised of steel, although other suitable shapes and materials can also be used. In addition, where desired, the housing 155 and retaining member 157 may be provided as one-piece.

The mounted bracket 124 in this embodiment comprises a wall 153 having a perimeter defining two opposing sides attached with first and second end walls 170 and 171, respectively. In this embodiment, the first and second end walls 170 and 171 are substantially transverse inner and outer surfaces of the wall 153 defining a generally U-shaped mounting bracket 124, as best illustrated in FIG. 10. The mounting bracket 124 in this embodiment further comprises means positioned distal the attachment of the wall 153 with the end walls 170 and 171 for attaching the mounting bracket 124 to a panel, such as the panel member 58 shown in FIG. 1. In addition, the mounting bracket 124 in this embodiment includes an opening 116 generally circular in configuration extending through the wall 153. In this embodiment, preferably the diameter of the opening 116 is sized at least as large as the diameter of the threaded shank 113 of the keeper pin 112, and more preferably the diameter of the opening 116 is sized to be larger than the diameter of the threaded shank 113 of the keeper pin 112 for the purpose described below.

The assembly of the floating keeper sub-assembly 100 and attachment to a panel, such as the panel member 58 shown in FIG. 1, will now be described. In this embodiment, the assembly of the floating keeper sub-assembly 100 can be accomplished either before or after attachment of the mounting bracket 124 to the respective panel member. For purposes of this illustration, it will be considered that assembly of the floating keeper sub-assembly 100 is made prior to attachment to the panel member. In this scenario, the keeper pin 112 may be attached with the housing 155 and retaining member 157 either before or after being inserted into the opening 116 in the mounting bracket 124. In instances where the keeper pin 112 would be inserted first into the mounted bracket 124, the nose 115 may be inserted up from the bottom of the mounting bracket 124 or the distal end of the keeper pin 112 may be inserted in a downward direction through opening 116 in the mounting bracket 124. In another embodiment not shown, the nose 115 may be provided having a diameter larger than that of the opening 116, so that the keeper pin 112 may only be installed by inserting the distal end through the opening 116 of the mounting bracket 124. After the keeper pin 112 is positioned within the opening 116, the keeper pin 112 is inserted into the opening 156 through the housing 155 and is connected with the retaining member 158 via engagement of the threaded aperture 158. As illustrated in the bottom plan view of FIG. 11, the rotational position of the retaining member 158 is maintained through engagement with the inner surfaces of the end walls 170 and 171, as the keeper pin 112 is rotated either clockwise or counterclockwise to adjust its lateral position during operation, which is described in detail below.

The floating keeper sub-assembly 100 is attached to a panel member in the same manner illustrated in FIG. 1 via two retaining screws passing through the openings in the end walls 170 and 171 of the mounting bracket 124. The difference in the present embodiment is that the keeper pin 112 is preferably positioned generally perpendicular to the surface of the panel, whereas the keeper pin 12 shown in FIG. 1 is positioned generally parallel to the surface of the panel member 58. As a result of the position of the keeper pin 112 in this embodiment, preferably the panel is provided with an opening therein in order to receive the distal end of the keeper pin 112 upon lateral adjustment. Also, in this embodiment, preferably the end surface 161 of the retaining member 157 opposite the housing 155 is in engagement with a surface of the panel when the mounting bracket 124 is attached, which operates to keep the floating keeper sub-assembly 100 in its assembled position.

The operation of the floating keeper sub-assembly 100 for latching and unlatching in relation to the latch sub-assembly 9 shown in FIG. 1 will now be described. In this embodiment, the keeper pin 112 is adapted to be moved along the longitudinal axis of the wall 153 due to the preferably smaller diameter of the threaded portion 113 of the keeper pin 112 relative to the opening 116 through the wall 153. Moreover, as illustrated in FIG. 10, in this embodiment, displacement of the keeper pin 112 along the longitudinal axis of the mounting bracket 124 between the end walls 170 and 171 can also be regulated by the spacing between the housing 155 and inner surfaces of the end walls 170 and 171. During operation, in this embodiment the position of the keeper pin 112 relative to the mounting bracket 124 is maintained due to the frictional engagement between the upper surface 163 of the housing 155 with the outer surface of the wall 153. Moreover, additional frictional resistance can be provided between the end surface 161 of the retaining member 157 with the surface of the panel member. As should be understood, the amount of movement of the keeper pin 112 in the direction of the longitudinal axis of the wall 153 is based on the difference in diameter between the keeper pin 112 and opening 116. In this embodiment, the keeper pin 112 may also be pivoted relative to the mounting bracket 124, which is a feature not present in the floating keeper sub-assembly 10. Pivoting of the keeper pin 112 is possible due to the elasticity of the housing 155. The pivoting motion of the keeper pin 112 in the present embodiment can occur even where the diameter of the opening 116 is of the same size as the diameter of the threaded portion 113 of the keeper pin 112. The pivoting movements of the keeper pin 112 is made possible in the present embodiment as a result of compression of only a portion of the housing 155. For example, with reference to FIG. 10, pivotal movement of the keeper pin 112 in the direction of arrow 163 will result in displacement of the nose 115 generally along the longitudinal axis of wall 153 and compression of the portion of the housing 155 adjacent to the end wall 170. Similar to that described in relation to the keeper sub-assembly 10, preferably the mounting bracket 124 is comprised of metal.

Figure 12:
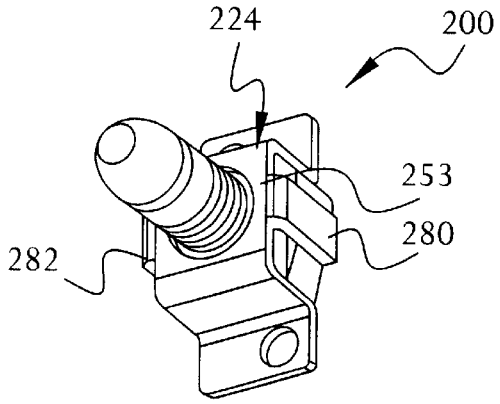
FIG. 12 is an isolated perspective view of another embodiment of the keeper sub-assembly of FIG. 1.
Figure 13:
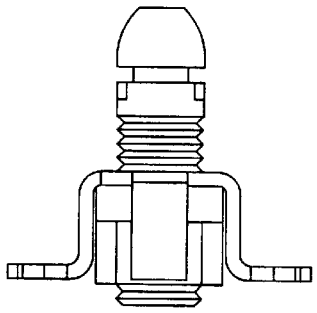
FIG. 13 is an isolated right side elevational view of the keeper sub-assembly of FIG. 12.
Figure 14:
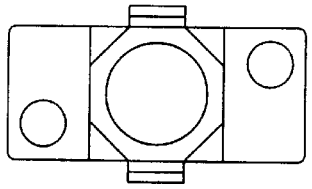
FIG. 14 is an isolated rear elevational view of the keeper sub-assembly of FIG. 12.

Still another embodiment of a floating keeper sub-assembly is illustrated in FIGS. 12–14. The floating keeper sub-assembly 200 as illustrated in FIGS. 12–14 is similar to that illustrated in FIGS. 9–11 with respect to the floating keeper sub-assembly 100, and for the sake of brevity, only those portions which are different will be described in detail herein. In the present embodiment, the floating keeper sub-assembly 200 comprises a mounting bracket 224 having third and fourth end walls 280 and 282 extending from opposite sides of the perimeter of the wall 253. Each of the end walls 280 and 282 in this embodiment are generally elongated and substantially rectangular in configuration, and when the floating keeper sub-assembly 200 is attached to a panel, preferably the free ends of the end walls 280 and 282 are at least adjacent and preferably in contact with a surface of the panel.

Figure 15:
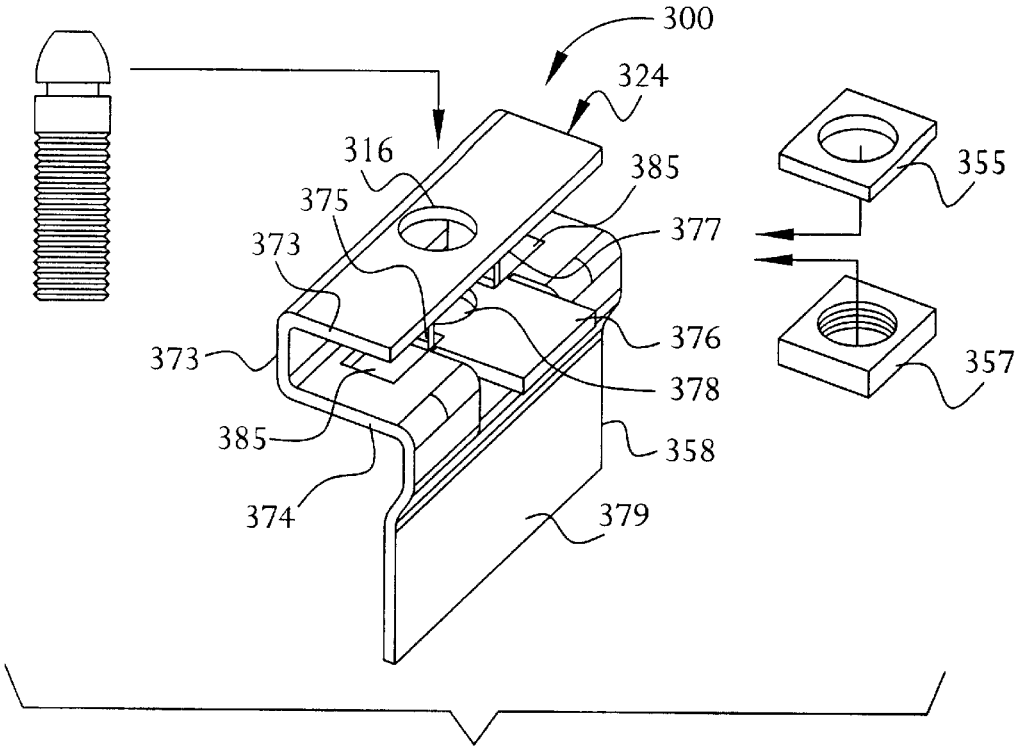
FIG. 15 is an isolated exploded perspective view of another embodiment of the keeper sub-assembly of FIG. 1.
Figure 16:
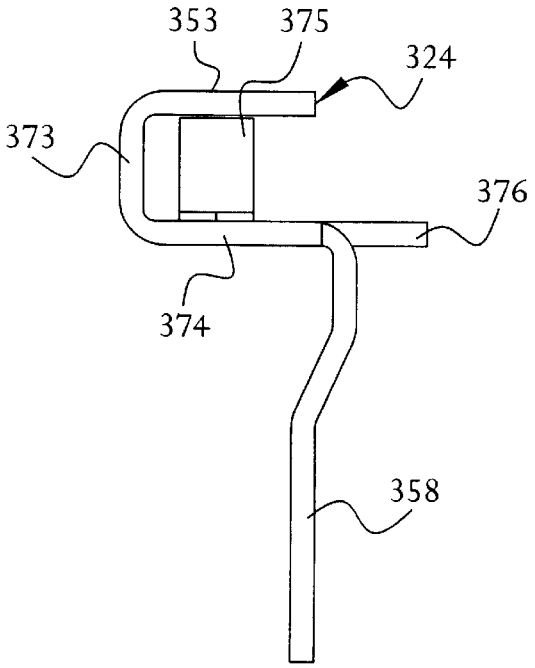
FIG. 16 is an isolated left side elevational view of a mounting bracket of FIG. 15.
Figure 17:
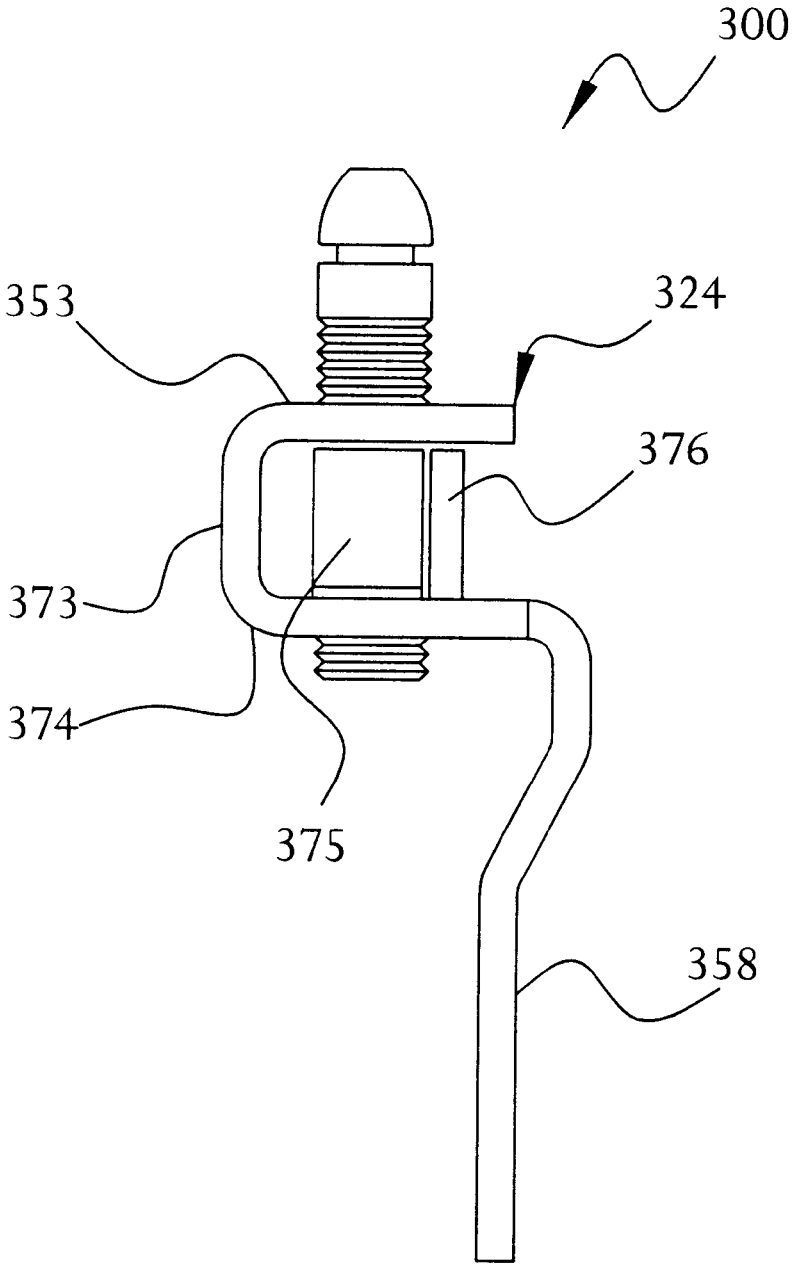
FIG. 17 is a left side elevational view of the keeper sub-assembly of FIG. 15 shown assembled.

Still another embodiment of a floating keeper sub-assembly of the present invention is illustrated in FIGS. 15–17. An exploded perspective view of the floating keeper sub-assembly 300 of the present embodiment is illustrated in FIG. 15 in an unassembled position. Similar to that described in relation to the floating keeper sub-assembly 200, only those portions which differ from the floating keeper sub-assembly 100 will be described in detail herein. As illustrated in FIG. 15, a mounting bracket 324 comprises a first wall 353, a first end wall 373 attached to the first wall 353, a second wall 374 attached to the first end wall 373, and second, third and fourth end walls 375, 376 and 377, respectively, attached with the second wall 374. The first wall 353 in this embodiment defines a perimeter generally rectangular in configuration and including an opening 316 therethrough generally circular in configuration. The first end wall 373 in this embodiment is also generally rectangular in configuration and is attached at its top to one side of the first wall 353 and attached at its bottom to one side of the second wall 374. In this embodiment, the first end wall 373 is positioned substantially transverse the longitudinal axis of the first wall 353. The second wall 374 in this embodiment is also generally rectangular in configuration defined by four sides and is substantially parallel to the first wall 353. The bottom of the first end wall 373 is attached to a first side of the second wall 374. In addition, a third end wall 376 is provided attached to a third side of the second wall 374 opposite the first end wall 373 and second and fourth end walls 374 and 377 are provided attached generally opposing each other to second and fourth sides of the second wall 374. As best illustrated in FIG. 16, the second and fourth end walls 375 and 377 prior to assembly are positioned substantially transverse the longitudinal axis of both the first wall 353 and second wall 374, and the third end wall 376 is positioned substantially parallel to the longitudinal axis of the first and second walls 353 and 374, respectively. In this embodiment, the second wall 374 also includes an opening 378 therethrough substantially circular in configuration and coaxial with the opening 316 through the first wall 353 and positioned between the first, second, third and fourth end walls 373, 375, 376 and 377, respectively. In addition, the mounting bracket 324 is shown attached to a panel 358 such as by spot welding, adhesive, rivets or the like. In this embodiment, the panel member 358 is attached to the third side of the second wall 374 adjacent to the third end wall 376. Similar to the floating keeper sub-assembly 100, the mounting bracket 324 preferably is comprised of formed metal, although other suitable configurations, materials and manufacturing processes can also be utilized for the same purpose. As shown in FIG. 15, in the present embodiment, the second wall 374 includes a pair of substantially rectangular cavities 385 therethrough resulting from the manufacturing process of forming the second and fourth end walls 375 and 377.

The assembly of the mounting bracket 324 with the keeper pin, housing and retaining member will now be described. The housing 355 and retaining member 357 shown in FIG. 15 are positioned within the cavity defined between the first through fourth end walls 373 and 375 through 377. The keeper pin is then preferably inserted in a downward direction first through the opening 316 in the first wall 353 and then through the opening through housing 355 and into the threaded opening through the retaining member 357. Thereafter, the keeper pin is rotated in a counterclockwise direction for adjusting its lateral position through the threaded engagement between the keeper pin and retaining member 357. A continued counterclockwise rotation of the keeper pin will position the distal end of the keeper pin through the opening 378 within the second wall 374. The housing 355 and retaining member 357 in this embodiment may be configured to substantially fill the space between the second and fourth end walls 355 and 377 and/or the space between the first and second walls 353 and 374, where desired. The assembly of the floating keeper sub-assembly 300 is completed by subsequent bending of the third end wall 376 in an upward direction toward the first wall 353 into the position illustrated in FIG. 17, which is substantially transverse the longitudinal axis of the first and second walls 353 and 374.

In other variations of the floating keeper sub-assembly 300, the keeper pin may be inserted from the opposite side of the mounting bracket 324 first into the opening 378 through the second wall 374 then through the opening 316 through the first wall 353. In addition, the retaining member 357 may be sized so that lateral adjustment of the keeper pin is made by rotation of the retaining member 357 rather than through rotation of the keeper pin as described above. In addition, the mounting bracket 324 may be provided having mounting holes through the second wall 374 for attachment directly to a panel similar to the floating keeper sub-assembly 100 rather than to the panel 358.

In view of that set forth above, it should be understood that there are several advantages to the floating keeper sub-assembly of the present invention. One advantage is that there are minimal components to accommodate alignment of the keeper pin relative to the mounting bracket and assembly of the separate components can be done both quickly and easily. In particular, the floating keeper sub-assembly 10 includes a housing preferably of one-piece in construction which is assembled to the mounting bracket by simple sliding fit installation. In addition, in the floating keeper subassemblies 100, 200 and 300, there are only two components required comprising a housing and a retaining member that are attached to the mounting bracket through engagement between the threaded portions of the keeper pin and retaining member. In addition, for the same reasons, adjustment of the keeper pin in a lateral direction generally perpendicular to the longitudinal axis of the mounting bracket is easily accomplished through mere rotation of the keeper pin or, alternatively where desired, by rotation of both the keeper pin and retaining member or by the retaining member alone.

Another advantage of the present invention is that concealment and encapsulation of the components for alignment can be utilized where desired. For example, in the floating keeper sub-assemblies 100, 200 and 300, the housing and retaining members are positioned on the side of the mounting bracket opposite the nose portion of the keeper pin. In addition, in the floating keeper subassembly 100, two end walls are also provided, and in the floating keeper sub-assemblies 200 and 300, four end walls are provided surrounding the sides of the housing and retaining member. Furthermore, the underside of the retaining member in the floating keeper sub-assemblies 100 and 200 are adjacent to the surface of the panel, and in the floating keeper sub-assembly 300, a second wall 374 is provided adjacent to the lower side of the retaining member.

It will be recognized by those skilled in the art that changes may be made by the above-described embodiments of the present invention without departing from the broad inventive concepts thereof It is understood, therefore, that this invention is not limited to the particular embodiments disclosed, but it is intended to cover all modifications which are within the scope and spirit of the invention as defined by the appended claims.

What is claimed is:

1. A self-aligning keeper comprising:

a generally elongated shaft having a threaded portion;

a bracket including at least one wall substantially elongated along a longitudinal axis defining an outer surface and an inner surface and an opening within said at least one wall extending through said outer and inner surfaces; and means for aligning said keeper when said keeper is in an assembled position for movement of said generally elongated shaft relative to said bracket at least along an x axis substantially parallel said longitudinal axis and along a y axis substantially perpendicular said longitudinal axis, said aligning means comprising a substantially non-metallic housing having an aperture there through for receiving said generally elongated shaft and engaging at least said outer surface of said at least one wall of said bracket proximate said opening extending through said bracket, said aligning means further comprising means for pivotal movement of said shaft relative to said bracket along a z axis including said threaded portion of said generally elongated shaft and said aligning means further comprising a retaining member positioned engaging said housing and spaced from said at least one wall of said bracket and with said retaining member including a threaded aperture for receiving said threaded portion of said generally elongated shaft, whereby alignment of said keeper is accomplished through movement of said generally elongated shaft relative to said bracket.

2. A self-aligning keeper of claim 1, wherein said housing is comprised substantially of an elastomeric material.

3. A self-aligning keeper of claim 2, wherein said housing is generally square in configuration and said retaining member comprises a retaining nut.

4. A self-aligning keeper of claim 1, wherein said at least one wall of said bracket includes a perimeter defining at least two opposing sides, with said bracket further including first and second end walls attached to said at least two opposing sides of said at least one wall, respectively, with said first and second end walls being substantially transverse said inner and outer surfaces of said at least one wall defining a generally U-shaped bracket.

5. A self-aligning keeper of claim 4, wherein said first and second end walls of said bracket further comprise means positioned distal said attachment with said at least one wall for attaching said bracket to a panel.

6. A self-aligning keeper of claim 5, wherein said at least one wall of said bracket further comprise a perimeter having four sides, with said bracket further comprising third and fourth end walls attached to opposing sides of said at least one wall and positioned substantially transverse said inner and outer surfaces of said at least one wall of said bracket.

7. A self-aligning keeper of claim 1, wherein said at least one wall of said bracket defines a perimeter having at least one side, with said bracket further including a first end wall having a top and a bottom, said top of said first end wall being attached to said at least one side and said first end wall being positioned substantially transverse said longitudinal axis of said at least one wall, wherein said bracket further includes a second wall attached to said bottom of said first end wall and positioned substantially parallel to said at least one wall, with said second wall defining four sides and having a hole therethrough co-axial with said hole through said at least one wall, wherein said first and third sides of said second wall are positioned opposite to each other and said second and fourth sides of said second wall are positioned opposite to each other, with said first side of said second wall being attached to said bottom of said first end wall, said second side of said second wall attached with a second end wall generally parallel to said first end wall, said third side of said second wall attached with a third end wall generally parallel to said first end wall, and said fourth side of said second wall being attached with a fourth end wall generally parallel to said first end wall, wherein a cavity is defined between said first end wall, said second end wall, said third end wall and said fourth end wall into which said housing and said retaining member are positioned.

8. In a blind latching system for enclosures having a closure element moveable between open and closed positions and a fixed element, the combination of a keeper sub-assembly adapted for attachment to said fixed element, a latch sub-assembly adapted for attachment to a surface of said closure element and including a latch positioned for cooperative latching action with said keeper sub-assembly and release means operatively positioned relative to said latch for unlatching said latch sub-assembly from said keeper sub-assembly, said keeper sub-assembly being provided with a bracket having at least one wall defining opposing inner and outer surfaces extending in a longitudinal direction and having an opening therein, a keeper pin projecting through said opening and means for aligning said keeper pin for movement of said keeper pin relative to said bracket along an x axis, a y axis and a z axis comprising a resilient housing defining outer and inner surfaces and having an opening therethrough receiving said keeper pin, with said inner surface of said housing engaging ad outer surface of said at least one wall.

9. An apparatus of claim 8, wherein said keeper pin comprises a generally elongated shaft including a threaded portion and said aligning means further comprises a retaining member positioned engaging said housing and spaced from said at least one wall of said bracket and with said retaining member including a threaded aperture for receiving said threaded portion of said generally elongated shaft.

10. An apparatus of claim 9, wherein said housing is comprised substantially of an elastomeric material.

11. An apparatus of claim 10, wherein said housing is generally square in configuration and said retaining member comprises a retaining nut.

12. An apparatus of claim 9, wherein said at least one wall of said bracket includes a perimeter defining at least two opposing sides, with said bracket further including first and second end walls attached to said at least two opposing sides of said at least one wall, respectively, with said first and second end walls being substantially transverse said inner and outer surfaces of said at least one wall defining a generally U-shaped bracket.

13. An apparatus of claim 12, wherein said first and second end walls of said bracket further comprise means positioned distal said attachment with said at least one wall for attaching said bracket to a panel.

14. An apparatus of claim 13, wherein said at least one wall of said bracket further comprise a perimeter having four sides, with said bracket further comprising third and fourth end walls attached to opposing sides of said at least one wall and positioned substantially transverse said inner and outer surfaces of said at least one wall of said bracket.

15. An apparatus of claim 9, wherein said at least one wall of said bracket defines a perimeter having at least one side, with said bracket further including a first end wall having a top and a bottom said top of said first end wall being attached to said at least one side and said first end wall being positioned substantially transverse said longitudinal axis of said at least one wall, wherein said bracket further includes a second wall attached to said bottom of said first end wall and positioned substantially parallel to said at least one wall, with said second wall defining four sides and having a hole therethrough co-axial with said hole through said at least one wall, wherein said first and third sides of said second wall are positioned opposite to each other and said second and fourth sides of said second wall are positioned opposite to each other, with said first side of said second wall being attached to said bottom of said first end wall, said second side of said second wall attached with a second end wall generally parallel to said first end wall, said third side of said second wall attached with a third end wall generally parallel to said first end wall, and said fourth side of said second wall being attached with a fourth end wall generally parallel to said first end wall, wherein a cavity is defined between said first end wall, said second end wall, said third end wall and said fourth end wall into which said housing and said retaining member are positioned.

16. An apparatus of claim 15, wherein said latch sub-assembly comprises:

a latch plate member positioned generally perpendicular to an axis of said keeper pin when said closure element is in a closed position, said plate member having a circular hole therethrough of a size and shape to receive said keeper pin;

a latch member movably mounted at an edge of said hole;

a first compression coil biasing spring positioned to bias said latch member radially inwardly relative to said hole to a limit position such that said latch member obstructs an edge portion of said hole, whereby when said closure element is moved to closed position, said keeper pin enters into said hole of said latch plate and cams said latch member radially outwardly against the action of said first biasing spring until a nose portion of said keeper pin passes, whereupon said latch member in response to the force of said first biasing spring enters a circumferencial slot of said keeper pin, thereby to effect latching of said latch mechanism;

a second compression coil biasing spring mounted co-axially with said keeper pin and positioned to be compressed by said keeper pin when said closure element is in closed position;

a cup retaining one end of said coil of said second biasing spring, said cup being mounted for movement along a projected axis of said keeper pin; and wherein said release means moves said latch member radially outwardly against the action of said first biasing spring, thereby to allow said compressed second biasing spring to expand, thereby to move said closure element in an opening direction.

17. A method for assembly of a keeper in a blind latching system comprising a keeper and a latch, said method including the steps:

providing said keeper having a bracket having at least one wall defining opposing inner and outer surfaces extending in a longitudinal direction and having an opening therein, a keeper pin comprising a generally elongated shaft including a threaded portion, a housing defining outer and inner surfaces and having an opening therethrough, and a retaining member including a threaded aperture therethrough, wherein said at least one wall of said bracket defines a perimeter having at least one side, with said bracket further including a first end wall having a top and a bottom, said top of said first end wall being attached to said at least one side and said first end wall being positioned substantially transverse a longitudinal axis of said at least one wall, wherein said bracket further includes a second wall attached to said bottom of said first end wall and positioned substantially parallel to said at least one wall, with said second wall defining four sides comprising first, second, third and fourth sides and said second wall having a hole therethrough co-axial with said opening through said at least one wall, wherein said first and third sides of said second wall are positioned opposite to each other and said second and fourth sides of said second wall are positioned opposite to each other, with said first side of said second wall being attached to said bottom of said first end wall, said second side of said second wall attached with a second end wall generally parallel to said first end wall, said third side of said second wall attached with a third end wall generally parallel to said second wall, and said fourth side of said second wall being attached with a fourth end wall generally parallel to said first end wall, wherein a cavity is defined between said first end wall, said second end wall and said fourth end wall;

inserting said housing and said retaining member into said cavity between said first end wall, said second end wall and said fourth end wall of said bracket;

inserting said keeper pin through said opening in said at least one wall of said bracket in a direction from said outer surface to said inner surface and into said cavity between said first end wall, said second end wall and said fourth end wall of said bracket;

positioning said keeper pin through said opening through said housing;

attaching said retaining member to said keeper pin by rotating at least one of said keeper pin or said retaining member; and bending said third end wall in an upward direction toward said at least one wall of said bracket.

* * * * *

UNITED STATES PATENT AND TRADEMARK OFFICE

CERTIFICATE OF CORRECTION

PATENT NO. : 6,149,213
DATED : November 21, 2000
INVENTOR(S) : William E. Sokurenko, D Dale Turner and James T. DeCecchis It is certified that error appears in the above-identified patent and that said Letters Patent is hereby corrected as shown below:

Column 10,
Line 12, "375" should be replaced with -- 374 --.

Signed and Sealed this

Sixth Day of November, 2001

*Attest:*

Nicholas P. Godici

NICHOLAS P. GODICI
*Acting Director of the United States Patent and Trademark Office*

*Attesting Officer*